United States Patent [19]

Ruenzi

[11] Patent Number: 4,555,106

[45] Date of Patent: Nov. 26, 1985

[54] APPARATUS FOR COLLATING SHEETS OF PAPER

[76] Inventor: Kurt Ruenzi, Kuesnachterstrasse 59, CH-8126 Zumikon, Switzerland

[21] Appl. No.: 543,984

[22] Filed: Oct. 20, 1983

[30] Foreign Application Priority Data

Oct. 27, 1982 [CH] Switzerland ..... 6266/82

[51] Int. Cl.[4] ..... B65H 29/58

[52] U.S. Cl. ..... 271/297; 271/305; 271/274

[58] Field of Search ..... 271/297, 303, 305, 287, 271/274

[56] References Cited

U.S. PATENT DOCUMENTS

| | | | |
|---|---|---|---|
| 3,484,101 | 12/1969 | Cassano | 271/297 X |
| 4,026,540 | 5/1977 | Lawrence | 271/287 |
| 4,179,115 | 12/1979 | Ruenzi | 271/297 |
| 4,378,110 | 3/1983 | Greene | 271/305 X |

FOREIGN PATENT DOCUMENTS

| | | | |
|---|---|---|---|
| 78765 | 6/1981 | Japan | 271/287 |

*Primary Examiner*—Richard A. Schacher
*Attorney, Agent, or Firm*—W. G. Fasse; D. H. Kane, Jr.

[57] ABSTRACT

Sheets of paper coming from an office machine such as a copier, are collated in a collator having a vertically extending sheet feeding channel. Collating compartments forming a stack extend up from the channel at a slant. Each collating compartment cooperates with its lower end with one or two sheet feeding rollers and a tiltable guide flap. If a flap is in a passive position the respective transport roller, in cooperation with a counter-pressure roller, will move a sheet past the flap. If the flap is tilted into an active position its curved shape will guide a sheet out of the feeding channel into the respective collating compartment. The tiltable guide flaps are so arranged that they extend on both sides of a horizontal plane and of a vertical plane extending through a rotational axis of the respective sheet feeding roller or rollers. These features assure a sheet feeding free of troubles even if sheets of different lengths and of different thicknesses are to be collated.

7 Claims, 3 Drawing Figures

APPARATUS FOR COLLATING SHEETS OF PAPER

FIELD OF THE INVENTION

The invention relates to an apparatus for collating sheets of paper. Such an apparatus includes a plurality of depositing surfaces which form a stack. The stack is arranged vertically. Transport rollers for supplying the sheets of paper form a vertical sheet feeding channel equipped with guide flaps capable of deflecting a sheet of paper out of the sheet feeding channel onto a depositing surface. The deflecting guide flaps are operated by respective operating members for tilting the flaps between an active or a passive position. Sheets are deflected onto the depositing surfaces in the active position of the flaps. Sheets are kept travelling in the sheet feeding channel in the passive position of the flaps.

DESCRIPTION OF THE PRIOR ART

U.S. Pat. No. 4,179,115 (Ruenzi) describes a sheet feeding and collating apparatus having a frame supporting a plurality of upwardly open collating compartments arranged in a row and slanting relative to the vertical. The frame also supports a sheet input feeder as well as a sheet transport and guide mechanism located above the collating compartments so that a sheet advancing roller is substantially aligned with an upper edge of each compartment. At least one tiltable guide gate is located above each compartment. The gates are sequentially operable by respective magnets in response to the movement of a sheet through a light beam to sequentially deflect the sheets into respective compartments. Each interruption of the light beam actuates a stepping switch which, in turn, connects the operating magnets sequentially to their respective energizing circuit. When the last compartment in a sequence has received a sheet, the stepping switch is reset to begin a new sequence in a ring-around fashion. The sheet input feeder is capable of receiving sheets, for example from a copier or printer, and to supply these sheets into the collator. Such an apparatus works fine, but requires a substantial office space.

It is further known to arrange the compartments of a collator vertically one above the other to use less space in the horizontal direction. However, the individual compartments slant downwardly so that it is difficult to accommodate sheets of different lengths unless each compartment has a length corresponding to the length of the longest sheet to be handled. However, when sheets of shorter length are being handled, the formation of proper stacks may be difficult because in connection with short sheets there is a spacing between the transport rollers forming the sheet advance channel and the respective edge of the stack being formed. Thus, sheets in the same stack may not be aligned relative to the stack edge. Further, the sheets sometimes have a tendency to slightly roll or vault, whereby following sheets are prevented from being deposited properly on a stack.

OBJECTS OF THE INVENTION

In view of the above it is the aim of the invention to achieve the following objects singly or in combination:

to construct a collating apparatus capable of collating sheets cf different lengths without any trouble so as to form stacks with properly aligned edges;

to construct a collating apparatus so that it is as compact as possible to take up as little office space as possible;

to assure a trouble-free sheet advance which will also handle sheets even if they are slightly creased and even if they run at a slight slant relative to the longitudinal feed advance direction to thereby reduce the sources which heretofore have caused problems in operating such collating devices; and to assure the proper sequence of sheets in a collating operation.

SUMMARY OF THE INVENTION

In the collating apparatus according to the invention the collating compartments are arranged in a stack and so that as viewed from their lower end cooperating with the sheet feeding channel they are slanted upwardly. The sheet deflecting guide flaps are located above the transport roller or rollers of the respective compartment. Each sheet deflecting flap has a curved cross-section and in the passive position of the flaps they reach into the space between the transport rollers and the position of these flaps is such that they extend on both sides of a horizontal plane extending through the respective rotational axis of the transport roller cooperating with the respective flap.

According to the invention the sheets must slide down against the lower end wall in each collating compartment because the bottom surface of each compartment slants upwardly. Thus, all sheets, regardless of their length, must slide downwardly and must abut against the lower end wall of the compartment, whereby the proper stack formation is assured even if sheets of different lengths must be accommodated in the same stack. This downward abutting of the sheets has the further advantage that even slightly creased sheets and sheets not exactly aligned will be properly handled since a sheet initially having a slant will straighten itself automatically when it abuts against the lower end wall of the compartment. These features greatly reduce the sources of trouble encountered heretofore. The spacing between the lower edge of a stack and the transport rollers remains constant regardless of the length of the sheets.

BRIEF FIGURE DESCRIPTION

In order that the invention may be clearly understood, it will now be described, by way of example, with reference to the accompanying drawings, wherein.

Figure 1:
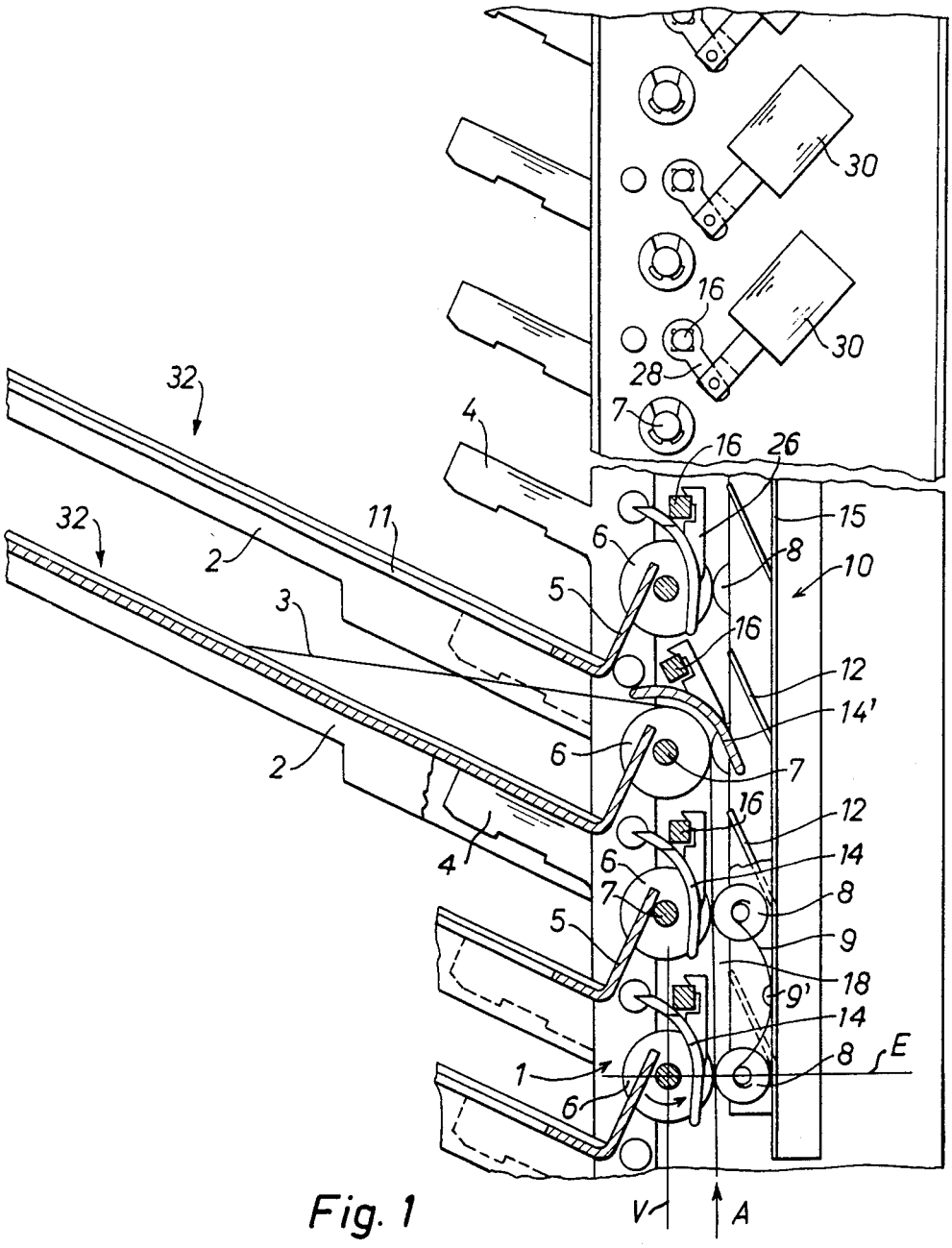
FIG. 1 is a side view of the present collating apparatus partially in section and with parts broken away which are not essential for the clear understanding of the invention.

DETAILED DESCRIPTION OF PREFERRED EXAMPLE EMBODIMENTS AND OF THE BEST MODE OF THE INVENTION

The collating apparatus is capable of sorting sheets of paper coming, for example, from an office copying machine. The present apparatus is capable to assemble complete sets of copies in each of its collating compartments so that, for example, a brochure comprising several pages will have the pages assembled in the proper sequence and with at least one narrow edge properly aligned even if sheets of different length are involved. A frame structure 1 extends in the vertical direction and is provided with holding arms 4 slanting upwardly for removably or exchangeably carrying collating compartments 2 which slant upwardly accordingly at an angle as determined by the arms 4 which grip into respective elements of the compartments. Sheets of paper 3 are deposited on the upwardly facing slanted surface of the compartments to form stacks 32. A suitable slant angle relative to the horizontal has been found to be about 25°. Each compartment has a bottom 11 slanting at the just mentioned angle upwardly and an end wall 5 forming an abutment member extending approximately perpendicularly to the bottom 11.

The sheets are supplied into the collator in the direction of the arrow A vertically upwardly, whereby the sheets 3 enter into a vertically arranged sheet feeding channel 18 including sheet feeding transport rollers 6 arranged, for example in pairs vertically, one pair above the other and cooperating with back-up or counter-pressure rollers 8. The feed advance rollers 6 and the counter-pressure rollers 8 form a vertically extending sheet feeding path, whereby the lowest set of rollers 6 and 8 forms an infeed gap. The counter pressure rollers 8 are yieldingly supported by leaf springs 9 which are in turn rigidly secured to a tiltable cover 10 as shown at 9'. Each leaf spring 9 is arranged to hold a counter-pressure roller at each of its ends. The cover 10 is tiltable about a vertical hinging axis secured to the frame 1, but not shown for simplicity's sake. By tilting the cover 10 out of the position shown in FIG. 1, the entire feeding path and the components thereof are directly accessible for easy maintenance. The cover is further equipped with deflection tongues 12 reaching upwardly at a slant between the respective counter-pressure rollers 8. Preferably, these sheet deflection tongues 12 are directly bent out of the cover wall 15 made, for example, of sheet metal. The deflection tongues 12 make sure that sheets are safely guided along the feeding path 18.

Figure 3:
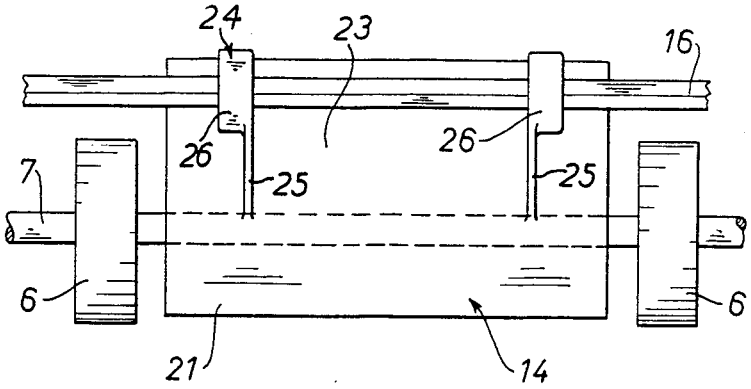
FIG. 3 is a top plan view of the arrangement of a sheet deflecting guide flap between two transport or sheet feeding rollers.

Each of the vertically arranged sheet feeding rollers 6 is supported on a horizontal shaft 7 which is driven by a positive drive mechanism such as a chain drive or the like not shown. Several rollers 6 may be axially spaced on the same drive shaft 7 as best seen in FIG. 3. All of the shafts 7 are driven in synchronism in the same direction, for example by the mentioned chain drive or by a gear pulley or the like.

Sheet deflecting means including guide flaps are arranged vertically along the sheet feeding path. Guide flaps 14 are shown in a passive position in which they permit a sheet 3 to pass by the deflecting flap. Sheet deflection flap 14' is shown in an active position in which it deflects a sheet out of the path 18 into a collating compartment 2. The tilting or flipping of a flap between the passive and active positions is accomplished by an operating arm 28 driven by a magnetic drive 30, whereby all the electromagnetic drives are operated in the desired sequence by a control mechanism not shown since it is not part of the invention. The operating arms 28 are secured to a lateral end of drive rods 16, for example, in the form of square sectional stock to which the sheet deflecting guide flaps 14, 14' are secured by projections 24. The ends of the drive rods are supported in bearings in the frame 1.

A drive rod 16 and the corresponding sheet feeding roller drive shaft 7 are arranged relative to each other in such a position that the respective sheet guiding and deflecting flap 14 extends on both sides of a horizontal plane E passing through the drive shaft 7 when the respective flap is in the passive position as shown at the two lower flaps 14 in FIG. 1. The position of the rod 16 and of the shaft 7 is further so selected that the flap 14 extends on both sides of a vertical plane V also extending through the longitudinal axis of the drive shaft 7. This position, or rather extension of the flaps on both sides of the two mentioned planes E and V, also holds true when the flap is in the active position as shown for flap 14' which is the third flap up in FIG. 1. In this position the flap 14' deflects a sheet at an angle of about 90°. Incidentally, the horizontal plane E also extends through the rotational axis of the respective counter-pressure roller 8 as best seen in FIG. 1. A plurality of flaps 14, 14' may be carried by a single operating rod 16. Similarly, a plurality of drive rollers or sheet feeding rollers 6 may be arranged on the respective drive shafts 7. The arrangement is such, that a flap 14 will reach into the spacing between two adjacent rollers 6 as best seen in FIG. 3.

Figure 2:
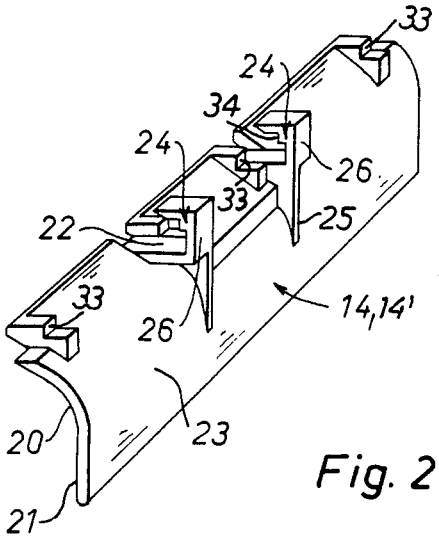
FIG. 2 is a perspective view of one of the sheet deflecting guide flaps.

As best seen in FIG. 2, each sheet guiding deflecting flap 14, 14' comprises a curved inwardly facing surface portion 20 having an arc of about 90° or of a quarter circle. A further flap portion 21 is flat and merges substantially tangentially into the curved portion 20. Each flap is equipped on its back 23 with one or more projections 24 performing two functions. For the first function, each projection 24 is provided with a rearwardly facing flat guide surface 26 for guiding sheets along the feed advance path 18 when a flap is in the passive position as described above. In this passive position of a flap, the respective guide surface 26 extends in parallel to the longitudinal axis of the feed advance path 18 so that the surfaces 26 cooperating with one another can properly guide a sheet 3. The projections 24 have arms 25 which, on the one hand smoothly merge into the back 23 of the respective flap and which on the other hand also smoothly merge into the flat surface 26 to form an extension of such flat surface, whereby these flat surfaces can cooperate with the flat back of the flap portion 21 in the guiding of the sheets.

The second function of the projections 24 is to secure the flaps to the drive rods 16. For this purpose the flaps are provided with a guide surface or recess 22 in which the rod 16 is received to snap behind a shoulder 33, 34 on the back of the respective flap. Thus, each flap is flexibly mounted on its rod 16 for movement with the rod between the above mentioned active and passive positions. As best seen in FIG. 1, the rods 16 are arranged above the respective roller drive shaft 7, but slightly laterally displaced relative to the respective vertical plane V so as to assure the above mentioned positioning of the flaps relative to the planes E and V. The lateral displacement of the rods 16 relative to the vertical plane V is toward the transport path 18 whereby the axial spacing between a shaft 7 and the respective rod 16 corresponds approximately to the diameter of the transport rollers 6.

In operation, a sheet 3 deflected by a flap 14' is first deposited by gravity on a stack 32 somewhat above the abutment end wall 5 of the respective compartment, whereupon it slides down, again by gravity, to abut against the abutment member 5. The abutment member 5 is provided with slots into which the roller 6 may reach as best seen in FIG. 1.

Although the invention has been described with reference to specific example embodiments, it will be appreciated that it is intended to cover all modifications and equivalents within the scope of the appended claims.

What is claimed is:

1. An apparatus for collating sheets of paper, comprising frame means, sheet feeding channel means including sheet feeding roller means defining a vertically extending sheet feeding path in said frame means, a plurality of collating compartments held by said frame means in a vertical compartment stack, sheet deflecting means including guide flaps for each compartment and operatively arranged in said channel means above a respective sheet feeding roller means, operating means connected to said guide flaps for moving a respective guide flap into a passive position in which a sheet may pass the guide flap and into an active position in which a sheet is deflected into a respective collating compartment, support means in said frame means for holding each collating compartment at an upward slant so that a lower compartment end reaches into a position for cooperating with a respective one of said sheet feeding roller means and for cooperation with a respective guide flap, said operating means for said guide flaps supporting said guide flaps above the respective sheet feeding roller means in such a manner that each guide flap reaches in its passive position into a space between adjacent feeding roller means and so that each guide flap extends on both sides of a horizontal plane passing through a rotational axis of the respective feeding roller means, each guide flap having a cross-sectional shape at least a portion of which is curved for deflecting a sheet into a respective compartment when the guide flap is in said active position, wherein said curved portion of each guide flap is arranged on one side of the respective flap for said deflecting, and wherein each guide flap comprises rear guide surface means on its back side for guiding a sheet along said sheet feeding channel means when the respective flap is in said passive position, wherein said rear guide surface means of each guide flap extend approximately in parallel to the longitudinal extension of said sheet feeding path when said guide flaps are in said passive position, said guide flaps (14) having on their upper rear part projections (24) carrying said rear guide surface means, wherein each of said collating compartments comprises a lower stop member (5) extending upwardly and reaching into a space between said sheet feeding roller means so that the upper ends of said guide flaps (14) reach over the respective stop member (5), wherein said curved portion of each guide flap is substantially circular and extends for about 90° and wherein each guide flap also comprises a flat portion extending substantially tangentially relative to said curved portion and away from a hinging axis of the respective guide flap, wherein said operating means comprise a square drive rod and means for releasably and flexibly securing said guide flaps to the respective square drive rod, and wherein said securing means comprise elastically yielding clamping elements for clamping the guide flaps to the respective square rod.

2. The apparatus of claim 1, wherein said sheet feeding channel means comprise a tiltable cover, counter-pressure rollers operatively supported in said cover for cooperation with said feeding roller means when said cover is in a channel closing position, and sheet deflecting tongues secured to said cover between adjacent counter-pressure rollers for keeping sheets in said path, said tongues having free ends extending upwardly at a slant in the direction of sheet advance.

3. The apparatus of claim 1, wherein said guide flaps are so located relative to a vertical plane passing through a rotational axis of said feeding roller means that each guide flap extends on both sides of said vertical plane in said passive position and in said active position of said guide flaps.

4. An apparatus for collating sheets of paper, comprising frame means, sheet feeding channel means including sheet feeding roller means defining a vertically extending sheet feeding path in said frame means, a plurality of collating compartments held by said frame means in a vertical compartment stack, sheet deflecting means including guide flaps (14) operatively arranged in said channel means above a respective sheet feeding roller means, operating means connected to said guide flaps for moving a respective guide flap into a passive position in which a sheet may pass the guide flap and into an active position in which a sheet is deflected into a respective collating compartment, support means in said frame means for holding each collating compartment at an upward slant so that a lower compartment end reaches into a position for cooperating with a respective one of said sheet feeding roller means and for cooperation with a respective guide flap, said operating means for said guide flaps supporting said guide flaps above the respective sheet feeding roller means in such a manner that each guide flap reaches in its passive position into a space between adjacent feeding roller means and so that each guide flap extends on both sides of a horizontal plane passing through a rotational axis of the respective feeding roller means, each guide flap having a cross-sectional shape at least a portion of which is curved for deflecting a sheet into a respective compartment when the guide flap is in said active position, and wherein said sheet feeding channel means comprise a cover (10) tiltable about a vertical axis secured to said frame means, counter-pressure rollers operatively supported in said cover (10) for cooperation with said feeding roller means when said cover is in a channel closing position, and sheet deflecting tongues (12) secured to said cover between adjacent counter-pressure rollers for keeping sheets in said path, said tongues having free ends extending upwardly at a slant in the direction of sheet advance, and wherein said guide flaps (14) reach behind a plane defined by said free ends of said sheet deflecting tongues (12) in the active position of said guide flaps (14).

5. The apparatus of claim 4, wherein each of said collating compartments comprises a lower stop member extending upwardly and reaching into a space between said sheet feeding roller means.

6. The apparatus of claim 4, wherein said guide flaps (14) are so located relative to a vertical plane passing through a rotational axis of said feeding roller means that each guide flap extends on both sides of said vertical plane in said passive position and in said active position of said guide flaps.

7. An apparatus for collating sheets of paper, comprising frame means, sheet feeding channel means including sheet feeding roller means defining a vertically extending sheet feeding path in said frame means, a plurality of collating compartments held by said frame means in a vertical compartment stack, sheet deflecting means including guide flaps for each compartment and operatively arranged in said channel means above a respective sheet feeding roller means for positively feeding sheets into a respective compartment, operating means connected to said guide flaps for moving a respective guide flap into a passive position in which a sheet may pass the guide flap and into an active position in which a sheet is deflected into a respective collating compartment, support means in said frame means for holding each collating compartment at an upward slant so that a lower compartment end reaches into a position for cooperating with a respective one of said sheet feeding roller means and for cooperation with a respective guide flap, said operating means for said guide flaps supporting said guide flaps above the respective sheet feeding roller means in such a manner that each guide flap reaches in its passive position into a space between adjacent feeding roller means and so that each guide flap extends on both sides of a horizontal plane passing through a rotational axis of the respective feeding roller means, each guide flap having a cross-sectional shape at least a portion of which is curved forming a curved guide surface for deflecting a sheet into a respective compartment when the guide flap is in said active position, and wherein said guide flaps have on their upper rear part projections (24) including rearwardly facing guide surfaces (25, 26) extending in parallel to said sheet feeding path when said guide flaps are in said passive position, said guide flap operating means extending through said guide flap projections so that said guide flap operating means are located between said rearwardly facing guide surface of said projections and said curved guide surface, whereby said operating means are prevented from interfering with a sheet advance at all times.

* * * * *